US010728638B2

(12) United States Patent
Leonhardt et al.

(10) Patent No.: US 10,728,638 B2
(45) Date of Patent: Jul. 28, 2020

(54) MICRO SPEAKER ASSEMBLY HAVING A MANUAL PUMP

(71) Applicant: Apple Inc., Cupertino, CA (US)

(72) Inventors: Oliver Leonhardt, San Francisco, CA (US); Onur I. Ilkorur, Campbell, CA (US); Justin D. Crosby, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/041,674

(22) Filed: Jul. 20, 2018

(65) Prior Publication Data

US 2019/0149899 A1 May 16, 2019

Related U.S. Application Data

(60) Provisional application No. 62/585,425, filed on Nov. 13, 2017.

(51) Int. Cl.

| | |
|---|---|
| ***H04R 1/02*** | (2006.01) |
| ***H04R 7/04*** | (2006.01) |
| ***H04R 1/32*** | (2006.01) |

(52) U.S. Cl.

CPC ..... *H04R 1/025* (2013.01); *H04R 1/026* (2013.01); *H04R 1/323* (2013.01); *H04R 7/04* (2013.01)

(58) Field of Classification Search

CPC ..... H04R 1/025; H04R 1/026; H04R 1/323; H04R 7/04; H04R 1/2807; H04R 1/2823;

(Continued)

(56) References Cited

U.S. PATENT DOCUMENTS 8,135,149 B2 3/2012 Yoshida et al.
9,185,480 B2 11/2015 Howes et al.

(Continued)

FOREIGN PATENT DOCUMENTS

CN 204190941 U 3/2015
CN 105049966 A 11/2015

(Continued)

OTHER PUBLICATIONS

Evaluation Report for Utility Model Patent of the State Intellectual Property Office of the People's Republic of China dated Jan. 19, 2020, for related Chinese Patent Application No. ZL2018217736321.

(Continued)

*Primary Examiner* — Sunita Joshi

(74) *Attorney, Agent, or Firm* — Womble Bond Dickinson (US) LLP

(57) ABSTRACT

A transducer assembly including a transducer enclosure having an enclosure wall separating a surrounding ambient environment from an encased space, and a transducer module positioned within the encased space. The transducer module has a module wall that divides the encased space into an exterior chamber and an interior chamber and defines a fluid port between the exterior chamber and the interior chamber, the exterior chamber is between the module wall and the enclosure wall, the interior chamber is between the module wall and a sound radiating surface positioned within the transducer module, and the interior chamber is acoustically coupled to an acoustic port to the surrounding ambient environment. The enclosure wall is movable relative to the module wall and movement of the enclosure wall causes ejection of a fluid out of the interior chamber to the ambient environment.

25 Claims, 7 Drawing Sheets

(58) Field of Classification Search
CPC ..... H04R 1/2846; H04R 25/654; H04R 2499/11; H04R 2499/15
See application file for complete search history.

(56) References Cited

U.S. PATENT DOCUMENTS

| | | | | |
|---|---|---|---|---|
| 9,363,589 | B2 | 6/2016 | Lippert et al. | |
| 9,461,605 | B2 | 10/2016 | Sekiyama | |
| 9,716,934 | B2 | 7/2017 | Qian et al. | |
| 2013/0028464 | A1 | 1/2013 | Hayashi et al. | |
| 2014/0169585 | A1* | 6/2014 | Howes | H04R 1/086 381/91 |
| 2014/0376757 | A1 | 12/2014 | Engle | |
| 2015/0163572 | A1* | 6/2015 | Weiss | H04R 1/02 381/337 |
| 2017/0208386 | A1 | 7/2017 | Yang et al. | |

FOREIGN PATENT DOCUMENTS

| | | | |
|---|---|---|---|
| CN | 204906680 | U | 12/2015 |
| CN | 204993740 | U | 1/2016 |
| JP | 2015037199 | A | 2/2015 |

OTHER PUBLICATIONS

First Office Action of the China National Intellectual Property Administration dated Apr. 24, 2020 for related Chinese Patent Application No. 201811281205.6.

* cited by examiner

MICRO SPEAKER ASSEMBLY HAVING A MANUAL PUMP

CROSS-REFERENCE TO RELATED APPLICATIONS

The application is a non-provisional application of U.S. Provisional Patent Application No. 62/585,425, filed Nov. 13, 2017 and incorporated herein by reference.

FIELD

This application relates generally to a micro speaker assembly from which a liquid can be manually ejected, more specifically, a micro speaker assembly having a pump for manual liquid ejection therefrom.

BACKGROUND

In modern consumer electronics, audio capability is playing an increasingly larger role as improvements in digital audio signal processing and audio content delivery continue to happen. In this aspect, there is a wide range of consumer electronics devices that can benefit from improved audio performance. For instance, smart phones include, for example, electro-acoustic transducers such as speakerphone loudspeakers and earpiece receivers that can benefit from improved audio performance. Smart phones, however, do not have sufficient space to house much larger high fidelity sound output devices. This is also true for some portable personal computers such as laptop, notebook, and tablet computers, and, to a lesser extent, desktop personal computers with built-in speakers. Many of these devices use what are commonly referred to as "micro speakers." Micro speakers are a miniaturized version of a loudspeaker, which use a moving coil motor to drive sound output. The moving coil motor may include a diaphragm (or sound radiating surface), voice coil and magnet assembly positioned within a frame. The input of an electrical audio signal to the moving coil motor causes the diaphragm to vibrate and output sound. The sound may be output from the sound output surface of the diaphragm to a sound output port through a front volume chamber that acoustically couples the sound output face to the output port. A back volume chamber may further be formed around the opposite face of the diaphragm to enhance sound output quality. In some cases, however, a volume of liquid may unintentionally enter the front volume chamber through the output port, and in turn, impact a sound quality output.

SUMMARY

In one aspect, the invention is directed to a transducer assembly, for example, a micro speaker assembly, having an integrated manual pump for fluid (e.g., water) ejection from the assembly. More specifically, in one aspect, the assembly includes aspects that allow for the manual ejection of liquids from a front cavity (e.g., front volume chamber) of the micro speaker. For example, in one aspect, the air trapped inside of a mobile device enclosure (within which the micro speaker is positioned) is used to create an air stream towards the exit of the micro speaker. This high velocity air stream then displaces, for example pushes, a volume of the liquid (e.g., water) within the front cavity. When the air stream displaces the volume of liquid in the front cavity, a pressure difference develops a net force over the liquid and the liquid is displaced until it is removed from the front cavity, via the exit port. The process may be repeated several times until the front cavity is completely clear of the liquid. In another aspect, the system pressure that results from the introduction of an air stream into the front cavity is used to pull or suck the volume of liquid from the front cavity. In addition, in some aspects, the nozzle, vent or fluid port which allows for the displacement of air from the mobile device enclosure into the front cavity, can be strategically placed to ameliorate modal issues arising from certain geometries of the front cavity. For example, the lambda/4 and 3lambda/4 acoustic resonances of the exit port can be ameliorated by strategically placing the fluid port along the cavity to achieve a desired leakage.

Representatively, in one aspect, the invention is directed to a transducer assembly including a transducer enclosure having an enclosure wall separating a surrounding ambient environment from an encased space. A transducer module may be positioned within the encased space and have a module wall that divides the encased space into an exterior chamber and an interior chamber and defines a fluid port between the exterior chamber and the interior chamber. The exterior chamber may be between the module wall and the enclosure wall and the interior chamber may be between the module wall and a sound radiating surface positioned within the transducer module. Still further, the interior chamber may be acoustically coupled to an acoustic port to the surrounding ambient environment. By "acoustically coupled" it is meant that an acoustic signal or output (e.g., a sound) can be transmitted from interior chamber to acoustic port. The enclosure wall may be movable relative to the module wall and movement of the enclosure wall causes ejection of a fluid out of the interior chamber to the ambient environment. Representatively, the module wall may include a top module wall that is parallel to a top enclosure wall of the enclosure wall, and the fluid port and the acoustic port may be formed through the top module wall. In some aspects, the interior chamber may have a length dimension, and the fluid port may be spaced a distance from the acoustic port that is at least ½ the length dimension of the interior chamber. Still further, the fluid port may include a surface area sufficient to allow for the passage of at least 0.1 cc of air from the exterior chamber to the interior chamber. In some aspects, the fluid is a liquid within the interior chamber, and the enclosure wall is movable in a manner sufficient to cause a volume of air within the exterior chamber to flow through the fluid port to the interior chamber and push the liquid through the acoustic port to the surrounding environment. In other aspects, the module wall may include a top module wall and a side module wall that is perpendicular to the top module wall, and the fluid port may be formed through the top module wall and the acoustic port is formed through the side module wall. Still further, the interior chamber may include a length dimension, and the fluid port is spaced a distance from the acoustic port that is less than ½ the length dimension of the interior chamber. The fluid port may have an angled interior surface to direct a flow of air generated by the movement of the enclosure wall from the exterior chamber toward the acoustic port. In addition, the fluid may be a liquid within the interior chamber, and the enclosure wall is movable in a manner sufficient to cause a volume of air within the exterior chamber to flow through the fluid port to the interior chamber and create a reduced pressure region within the interior chamber that pulls the liquid out the acoustic port. The assembly may further include an air permeable water barrier positioned over the fluid port, wherein the air permeable water barrier is permeable to air and resistant to water. In some cases, the transducer module may be a micro speaker module.

In other aspects, the invention is directed to an integrated micro speaker and pump assembly having a micro speaker enclosure having an enclosure wall separating a surrounding ambient environment from an encased space and a micro speaker module positioned within the encased space. The micro speaker module may have a module wall defining an acoustic chamber and a fluid port. The acoustic chamber may acoustically couple a sound radiating surface within the micro speaker module to an acoustic port that is open to the surrounding ambient environment and the fluid port may fluidly couple the acoustic chamber to the encased space surrounding the micro speaker module. By "fluidly couple" it is meant that a fluid, such as a liquid or gas, may flow through the fluid port. The fluid port allows for the passage of a first fluid from the encased space surrounding the micro speaker module to the acoustic chamber to drive a second fluid out of the acoustic chamber to the surrounding ambient environment. In some cases, the sound radiating surface may be a micro speaker diaphragm that generates a sound output, and the fluid port and the acoustic port face a direction parallel to a direction of the sound output. The fluid port may be spaced a distance from the acoustic port sufficient to allow the first fluid from the encased space surrounding the micro speaker module to enter the acoustic chamber and push the second fluid out of the acoustic chamber. In other aspects, the fluid port may face a direction parallel to a direction of the sound output from the micro speaker diaphragm and the acoustic port may face a direction perpendicular to the direction of sound output. In addition, the fluid port may be spaced a distance from the acoustic port sufficient to allow the first fluid from the encased space surrounding the micro speaker module to enter the acoustic chamber and create a negative pressure area near the acoustic port. The enclosure wall may be movable in response to an external force against the enclosure wall, and the external force may be in a direction of the transducer module. In some cases, a movement of the enclosure wall between a first position and a second position causes a volume of air to flow through the fluid port to the acoustic chamber. A volume of the acoustic chamber may be smaller than a volume of the encased space surrounding the micro speaker module. In addition, a surface area of the fluid port may be smaller than a surface area of the acoustic port. Still further, a water resistant membrane may be positioned over the fluid port, and the water resistant membrane may include polytetrafluoroethylene (PTFE).

In other aspects the invention is directed to a micro speaker system including a micro speaker having a front volume chamber that acoustically couples a sound radiating surface to an acoustic port for outputting a sound generated by the sound radiating surface to a surrounding ambient environment. The system may further include an electronic device enclosure surrounding the micro speaker, the electronic device enclosure having an enclosure wall that forms an exterior chamber around the micro speaker, the exterior chamber having a larger volume than the front volume chamber. In addition, the system includes a nozzle formed between the front volume chamber and the exterior chamber. The nozzle may allow for the passage of a volume of air from the exterior chamber to the acoustic chamber such that a volume of water within the acoustic chamber is pumped out the acoustic port to the surrounding ambient environment. The enclosure wall may be movable between a first position that is a first distance from the micro speaker and a second position that is a second distance from the enclosure wall, the second distance being less than the first distance, and a movement of the enclosure wall from the first position to the second position causes the volume of air to flow through the nozzle to the acoustic chamber. In addition, repeating the movement of the enclosure wall from the first position to the second position more than once causes the volume of air to flow through the nozzle to the acoustic chamber. Still further, the front volume chamber may include a negative pressure region between the nozzle and the acoustic port, and the negative pressure region draws the volume of water out the acoustic port. The enclosure wall may include an interior surface that shares a volume with the exterior chamber and an exterior surface that forms a cosmetic surface of the electronic device that is exposed to the surrounding ambient environment. The nozzle may include an air permeable mesh that is resistant to water.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The aspects are illustrated by way of example and not by way of limitation in the figures of the accompanying drawings in which like references indicate similar elements. It should be noted that references to "an" or "one" aspect in this disclosure are not necessarily to the same aspect, and they mean at least one.

DETAILED DESCRIPTION

In this section we shall explain several preferred aspects of this invention with reference to the appended drawings. Whenever the shapes, relative positions and other aspects of the parts described in the aspects are not clearly defined, the scope of the invention is not limited only to the parts shown, which are meant merely for the purpose of illustration. Also, while numerous details are set forth, it is understood that some aspects of the invention may be practiced without these details. In other instances, well-known structures and techniques have not been shown in detail so as not to obscure the understanding of this description.

The terminology used herein is for the purpose of describing particular aspects only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
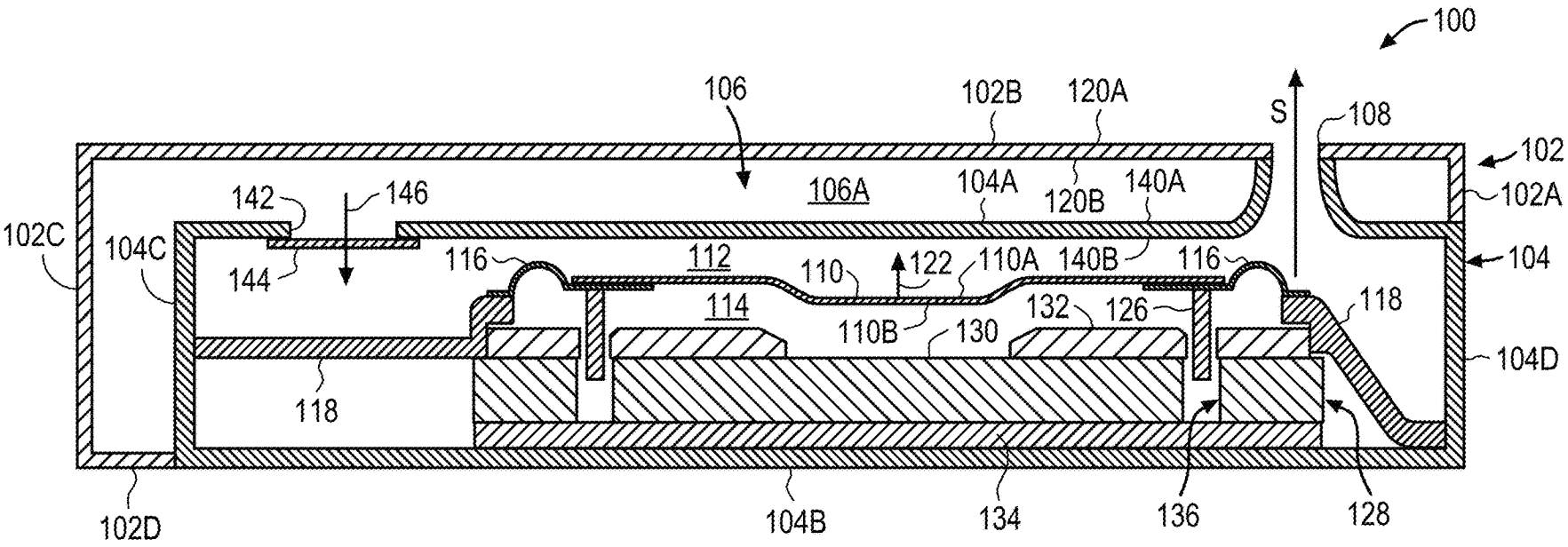
FIG. 1 illustrates a cross-sectional side view of one aspect of a transducer assembly.

FIG. 1 illustrates a cross-sectional side view of one aspect of a transducer assembly. Transducer assembly 100 may include, for example, an enclosure 102 within which a transducer module 104 is positioned. The enclosure 102 may be, for example, the cosmetic enclosure of an electronic device (e.g., a portable electronic device), which separates a surrounding environment from an encased space 106 therein. Representatively, enclosure 102 may include enclosure walls 102A, 102B, 102C and 102D, which each have an exterior surface 120A facing the surrounding environment and an interior surface 120B facing (or sharing a volume with) the encased space 106. One or more of enclosure walls 102A-102D, and more specifically the exterior surface 120A, may form the cosmetic surface of an electronic device that is visible to, or can be manipulated by, a user during operation of the device. For example, in one aspect, enclosure wall 102B may be considered a front wall that forms the surface of the display screen of the electronic device, while walls 102A, 102C and 102D form a first side wall, a second side wall and a back wall, respectively, of the electronic device. For example, the exterior surface 120A of enclosure wall 102B may be a touch sensitive surface of the display that allows for user input to the device.

Transducer module 104 may be positioned within encased space 106 of enclosure 102. Each of the components of a transducer, for example components of a speaker assembly as will be discussed herein, may be positioned, or otherwise enclosed within, transducer module 104. In some aspects, transducer module 104 may include a wall 104A, a wall 104B and walls 104C-104D, which form a top side (or top wall), a bottom side (or bottom wall) and side walls, respectively, of transducer module 104. The wall 104A may be substantially parallel to the wall 104B, and walls 104C and 104D may be parallel to each other and perpendicular to walls 104A and 104B. For example, walls 104C and 104D may connect wall 104A to wall 104B. In addition, at least one of the wall 104A or the wall 104B, and in some cases side walls 104C-104D (alone, in combination, or in combination with another encased transducer component) may form all, or a portion of, an acoustic channel or port 108. For example, in one aspect, the acoustic channel or port 108 may be formed through top wall 104A of transducer module 104 and top wall 102B of enclosure 102, such that the assembly is considered a "top firing" transducer. The acoustic channel or port 108 may acoustically connect a volume within transducer module 104 to the surrounding environment. For example, in the case of a micro speaker, the acoustic channel or port 108 may be a port (or elongated channel) that is acoustically coupled to a sound radiating component of the transducer and outputs sound (S) produced by the sound radiating component to the surrounding environment, as illustrated by the arrow.

In one aspect, the transducer may be, for example, an electroacoustic driver or transducer that converts electrical signals into acoustic signals (e.g., audible acoustic signals such as sound) that can be output from the device within which the transducer module 104 is integrated. For example, the transducer may be a micro speaker such as a speakerphone speaker or an earpiece receiver found within a smart phone, or other similar compact electronic device such as a laptop, notebook, tablet computer or portable time piece. In some aspects, for example, the transducer module 104 may include a 10 mm to 75 mm driver, or 10 mm to 20 mm driver (as measured along the diameter or longest length dimension), for example, in the case of a micro speaker.

In one aspect, one of the components of the transducer (e.g., speaker assembly components) positioned within the transducer module 104 may include a sound radiating surface (SRS) 110. The SRS 110 may also be referred to herein as an acoustic radiator, a sound radiator or a diaphragm, or a portion of one of these structures. SRS 110 may be any type of flexible plate, membrane or other structure, capable of vibrating in response to an acoustic signal to produce acoustic or sound waves. SRS 110 may include a top face 110A, which generates and outputs sound in a direction as indicated by arrow 122. The sound output by top face 110A travels through a first chamber to port 108, where it is output to the surrounding ambient environment, as illustrated by arrow (S). SRS 110 may also include a bottom face 110B, which is acoustically isolated from the top face 110A, so that any acoustic or sound waves generated by the bottom face 110B do not interfere with those from the top face 110A. The top face 110A may be referred to herein as the "top" face because it faces, or includes a surface substantially parallel to, the top module wall 104A. Similarly, the bottom face 110B may be referred to herein as the "bottom" face because it faces, or includes a surface substantially parallel to, the bottom module wall 104B. In some aspects, SRS 110 may have an out-of-plane region as shown (e.g. for geometric stiffening) or be substantially planar.

In some aspects, SRS 110 may be suspended within transducer module 104 by a suspension member 116, which is connected to one or more of module walls 104A-104D by a support member 118. Representatively, suspension member 116 may be a flexible membrane connected to a perimeter of SRS 110 along one side, and support member 118 along another side. The suspension member 116 may be, for example, a water resistant membrane and may attach SRS 110 to member 118 in a manner that seals SRS 110 to the module walls 104A-104D so that water cannot leak past SRS 110. For example, suspension member 116 may be overmolded to SRS 110 and/or support member 118. In addition, in some aspects, suspension member 116 may be a solid membrane that extends from one support member 118 to another, and SRS 110 may be a stiffening layer positioned on a top surface of suspension member 116. Still further, in some aspects, suspension member 116 may be connected directly to, for example, one or more of module walls 104C-104D, and support member 118 omitted. The support member 118 may be an additional wall, for example an interior wall, of transducer module 104. Support member 118 may be a separate structure that is attached to, for example an interior surface of one or more of module walls 104B-104D, or a structure that is integrally formed with one or more of module walls 104B-104D.

As illustrated in FIG. 1, module walls 104A, 104B, 104C and/or 104D may divide the encased space 106 of enclosure 102 into an exterior chamber 106A and an interior chamber 112 (within module 104). The exterior chamber 106A may surround the transducer module 104, and therefore also the interior chamber 112. Said another way, the exterior chamber 106A may be defined by, or otherwise be considered between, the interior surface 120B of enclosure walls 102A, 102B, 102C and/or 102D and an exterior surface 140A of one or more of module walls 104A, 104B, 104C and/or 104D. The interior chamber 112 may be defined by, or otherwise considered between, an interior surface 140B of one or more of module walls 104A, 104B, 104C and/or 104D, and top face 110A of SRS 110.

SRS 110 (in combination with suspension member 116 and/or support member 118), may in turn, separate the interior chamber 112 of transducer module 104 from a further chamber 114 within transducer module 104. Interior chamber 112 may acoustically connect top face 110A of SRS 110 to acoustic channel or port 108, and therefore be considered a front volume chamber. Chamber 114 may be acoustically coupled to the bottom face 110B of SRS 110 and therefore be considered a back volume chamber. In this aspect, the interior chamber 112 (or front volume chamber) may be considered between, and formed in part by, the top face 110A of the SRS 110 and top module wall 104A, and in some cases a side module wall 104C or 104D. Chamber 114 may, in turn, be considered between, and formed in part by, the bottom face 110B of SRS 110 and wall 104B, and in some cases wall 104C (or other side walls). The interior chamber 112 may be acoustically isolated from chamber 114 so that sound generated by top face 110A and bottom face 110B do not mix or otherwise interfere with one another.

As previously mentioned, interior chamber 112 is acoustically connected, or otherwise open, to port 108 and therefore serves as an acoustic channel or duct for outputting sound generated by SRS 110 to the surrounding ambient environment. Since port 108 is, however, open to the surrounding ambient environment, it can also serve as a conduit for fluid entry to interior chamber 112. For example, a liquid such as water could potentially enter port 108 and flow into interior chamber 112. It is noted that since interior chamber 112 and chamber 114 are isolated, or otherwise sealed off from one another, the water remains within interior chamber 112 and does not reach chamber 114. As such, the water will not interfere with any of the electronic components that may be housed within chamber 114. Any water within interior chamber 112 could, however, negatively impact a sound output of the transducer. It is therefore desirable to remove any water from interior chamber 112 as efficiently as possible. In this aspect, transducer assembly 100 further includes a manual pump assembly or mechanism for manually removing a liquid that may be contained within interior chamber 112.

Figure 4:
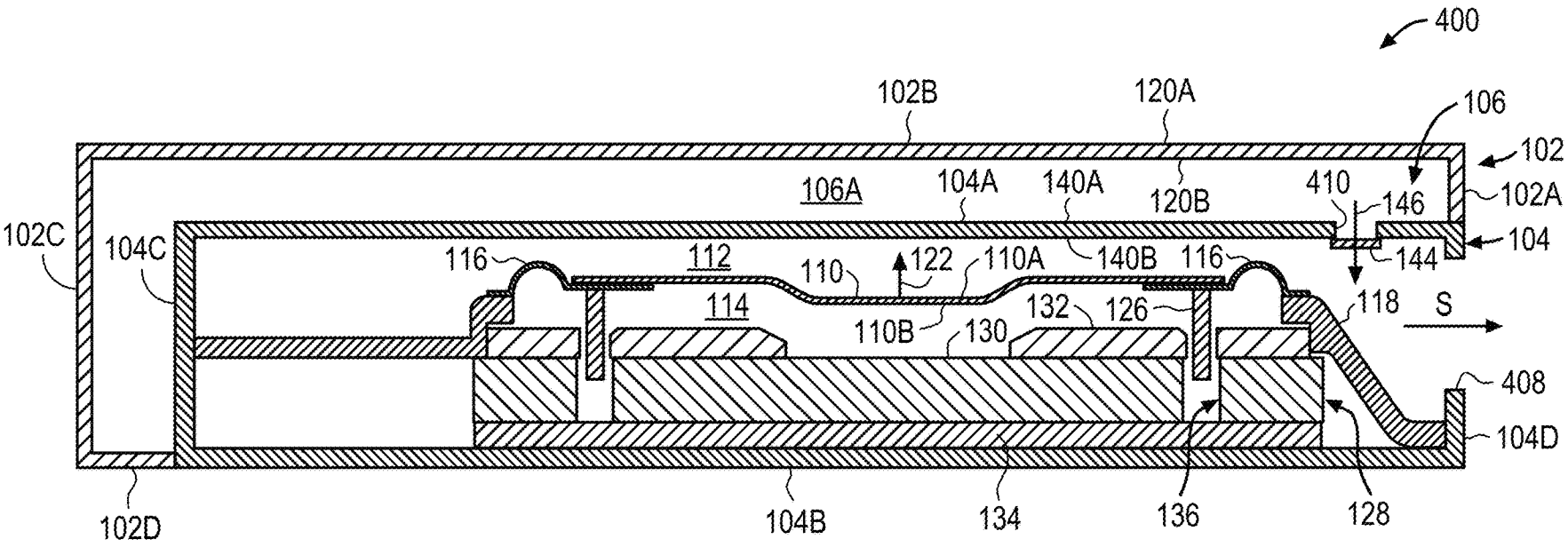
FIG. 4 illustrates a cross-sectional side view of another aspect of a transducer assembly.
Figure 5:
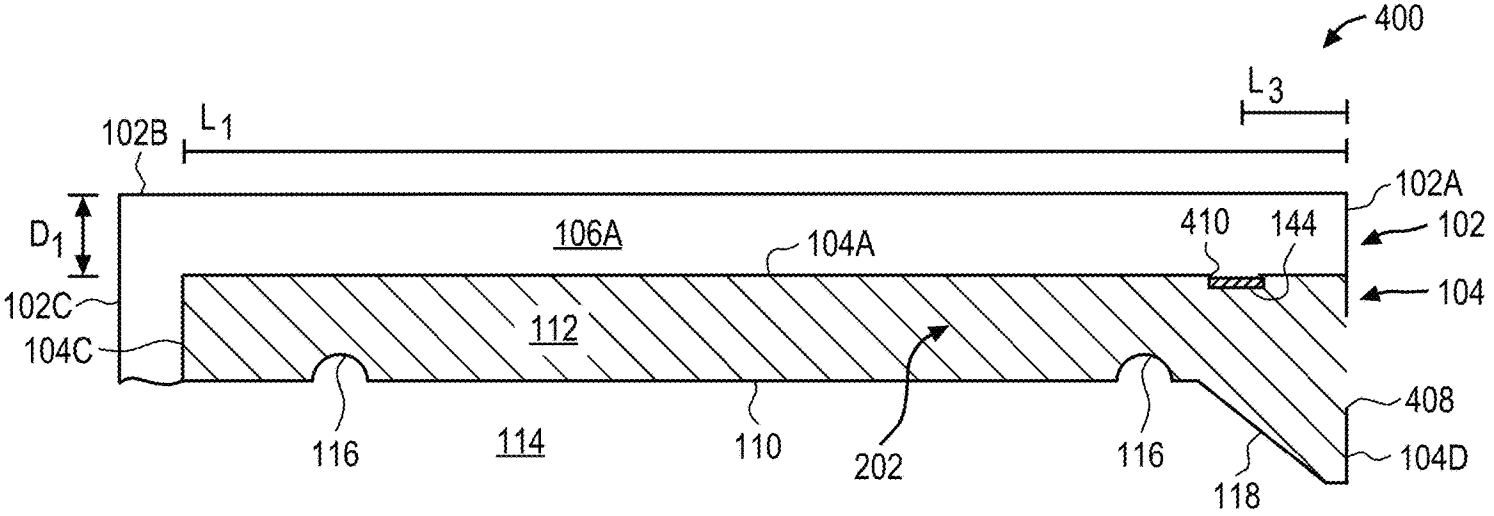
FIG. 5 illustrates a simplified schematic cross-sectional view of the transducer assembly of FIG. 4.
Figure 6:
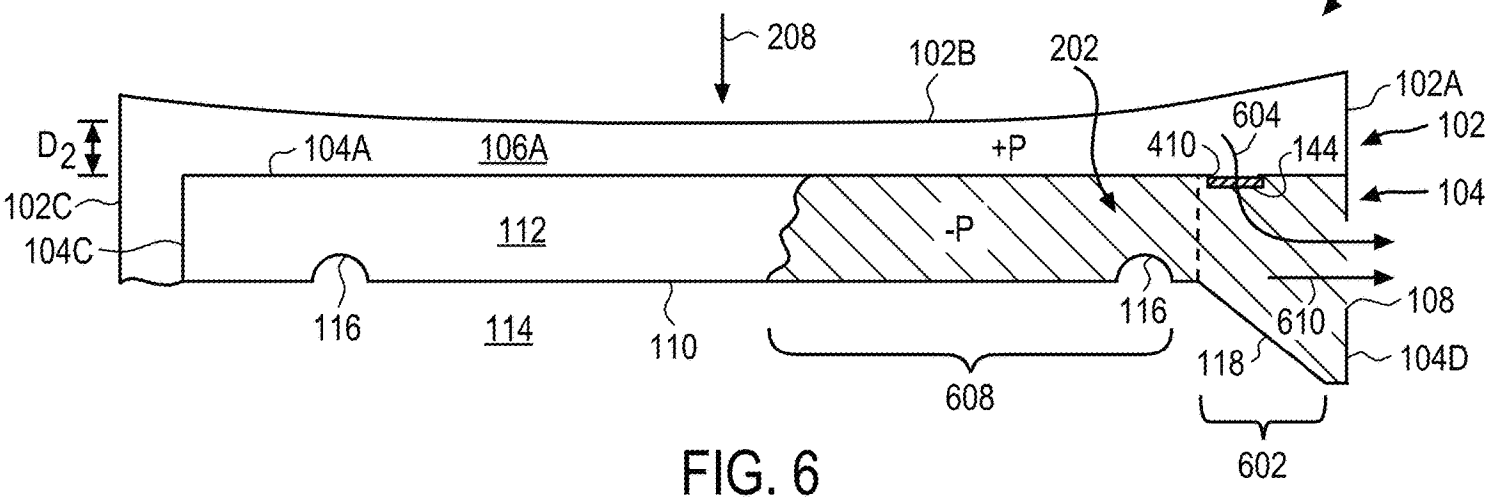
FIG. 6 illustrates a simplified schematic cross-sectional view of the transducer assembly of FIG. 4.

In one aspect, the manual pump assembly or mechanism may be considered integrally formed with the transducer assembly 100 because it utilizes various components of the enclosure 102 and transducer module 104 to eject, or otherwise pump, the water out of the interior chamber 112. Representatively, in one aspect, a nozzle or fluid port 142 may be formed through transducer module wall 104A to fluidly connect the exterior chamber 106A to interior chamber 112. The term "fluidly connected" is used herein to mean that a fluid, for example air, can flow or pass through fluid port 142, between exterior chamber 106A and interior chamber 112. This passage of fluid, or air, from exterior chamber 106A to interior chamber 112 in the direction as illustrated by arrow 146, can in turn, be used to displace a volume of liquid (e.g., water) within interior chamber 112 out acoustic port 108. The displacement of the liquid may occur by pushing or pulling the liquid out port 108, depending on a location of fluid port 142 with respect to acoustic port 108. The term "pushing" is used herein to refer to the application of a force against the liquid, in a direction of the port 108. The term "pulling" is used herein to refer to the application of a force that draws or sucks the liquid toward port 108. FIG. 1 illustrates an assembly in which the fluid port 142 is relatively far from acoustic port 108 so that the water is pushed out port 108 by the air flow into interior chamber 112. This mechanism will be described in more detail in reference to FIG. 2 and FIG. 3. FIG. 4-FIG. 6 illustrate an assembly in which fluid port 142 is relatively close to acoustic port 108 so that the water is pulled out port 108 by a suction force. It is further noted that although a fluid port 142 having a single opening is illustrated, fluid port 142 could be made up of a number of smaller openings, which in combination, have the same surface area as a single opening.

This pump assembly mechanism may further include a barrier 144 positioned over, or otherwise covering, fluid port 142. Barrier 144 may, for example, be an air permeable water resistant barrier that allows for the passage of air while being resistant to water passage. In other words, barrier 144 allows the air within exterior chamber 106A to pass through fluid port 142 to interior chamber 112, but prevents the water within interior chamber 112 from passing through fluid port 142 to exterior chamber 106A. Barrier 144 may, in one aspect, be made of a porous material having pores sized to resist the passage of water while still allowing for the passage of air. Representatively, barrier 144 may be an air permeable water resistant mesh or porous membrane. More specifically, in one aspect, barrier 144 may include polytetrafluoroethylene (PTFE). In still further aspects, barrier 144 may be a stack up of materials, for example, a layer of mesh in combination with a pressure sensitive adhesive layer. Barrier 144 may have a similar size, shape and/or surface area as fluid port 142, and be mechanically or chemically attached to portions of module wall 104A surrounding fluid port 142 such that it completely covers fluid port 142.

Returning now to the various components of the transducer assembly 100 within transducer module 104, a voice coil 126 is positioned along a bottom face 110B of SRS 110 (e.g., a face of SRS 110 facing magnet assembly 128). For example, in one aspect, voice coil 126 includes an upper end directly attached to the bottom face 110B of SRS 110, such as by chemical bonding or the like, and a lower end. In another aspect, voice coil 126 may be formed by a wire wrapped around a former or bobbin and the former or bobbin is directly attached to the bottom face 110B of SRS 110. In one aspect, voice coil 126 may have a similar profile and shape to that of SRS 110. For example, where SRS 110 has a square, rectangular, circular or racetrack shape, voice coil 126 may also have a similar shape. For example, voice coil 126 may have a substantially rectangular, square, circular or racetrack shape.

Transducer assembly 100 may further include a magnet assembly 128. Magnet assembly 128 may include a magnet 130 (e.g., a NdFeB magnet), with a top plate 132 and a yoke 134 for guiding a magnetic circuit generated by magnet 130. Magnet assembly 128, including magnet 130, top plate 132 and yoke 134, may be positioned such that voice coil 126 is aligned with magnetic gap 136 formed by magnet 130. For example, magnet assembly 128 may be below SRS 110, and in some cases, between SRS 110 and the bottom, or second enclosure wall 104B. In addition, in some aspects, top plate 132 may be specially designed to accommodate an out-of-plane region (e.g., a concave or dome shaped region) of SRS 110. For example, top plate 132 may have a cut-out or opening within its center that is aligned with the out-of-plane region of SRS 110. In this aspect, the additional space created below the out-of-plane region of SRS 110 allows SRS 110 to move or vibrate up and down (e.g., pistonically) without contacting top plate 132. In this aspect, the opening may have a similar size or area as the out-of-plane region. In addition, although a one-magnet assembly is shown here, although multi-magnet motors are also contemplated.

In addition, although not shown, transducer assembly 100 may include circuitry (e.g., an application-specific integrated circuit (ASIC)) or other external components electrically connected to the transducer to, for example, drive current through the voice coil 126 to operate the transducer.

Figure 2:
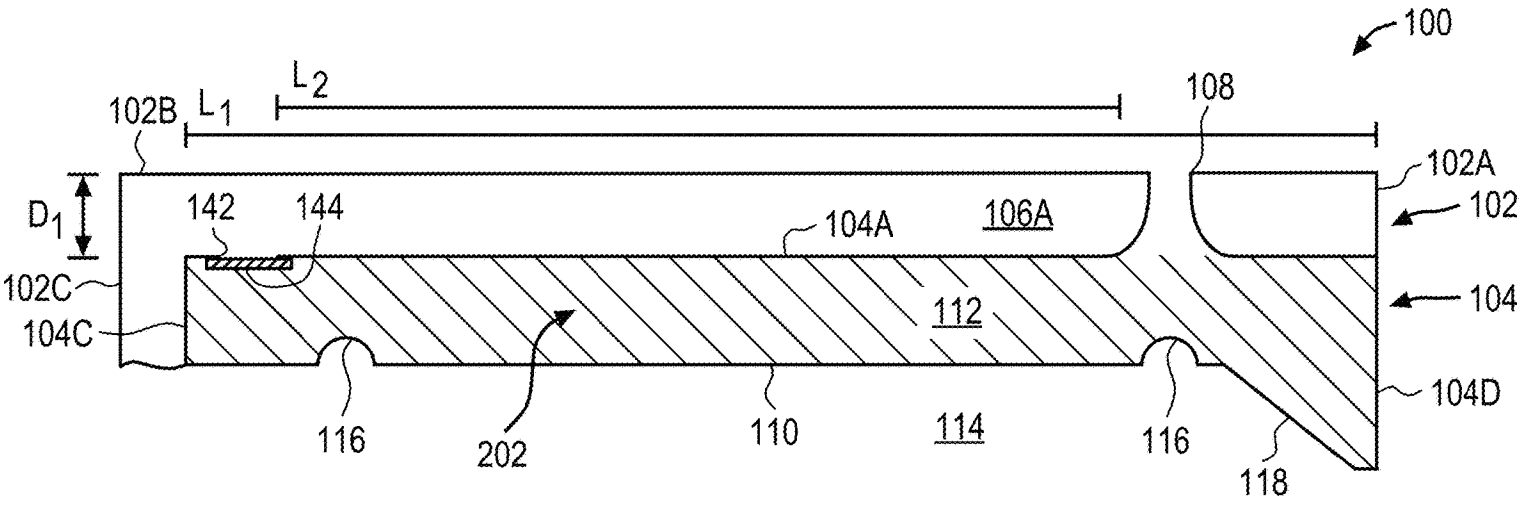
FIG. 2 illustrates a simplified schematic cross-sectional view of the transducer assembly of FIG. 1.
Figure 3:
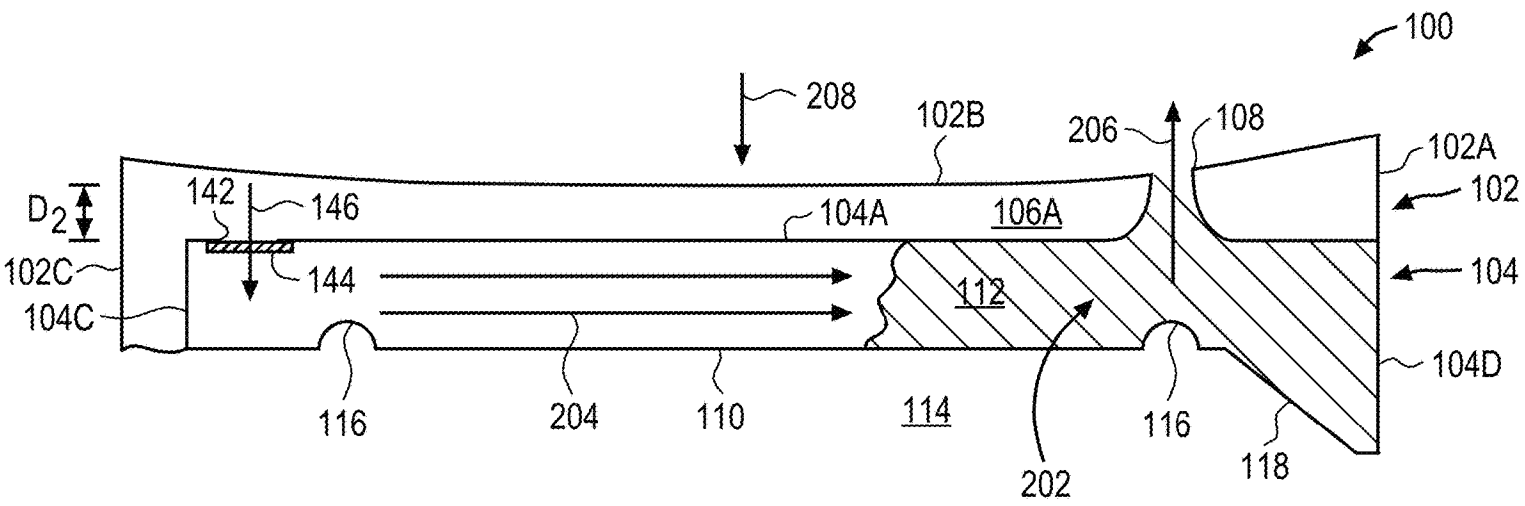
FIG. 3 illustrates a simplified schematic cross-sectional view of the transducer assembly of FIG. 1.

Referring now in more detail to the operation of the pumping assembly or mechanism for removing liquids, FIG. 2 and FIG. 3 illustrate the operation of the pumping mechanism of FIG. 1. It should be noted that FIG. 2 and FIG. 3 are simplified schematic views in which various details of FIG. 1 have been removed, for simplicity. In particular, FIG. 2 shows interior chamber 112 formed by module wall 104A and the top face 110A of SRS 110. From this view, it can be clearly seen that interior chamber 112 is essentially an acoustic channel or tube through which sound can travel to acoustic port 108. Similarly, a liquid 202, for example water, within interior chamber 112 can travel to acoustic port 108 and out to the ambient environment if a sufficient driving force is applied along the channel. In this case, the driving force may be a flow of air passing from exterior chamber 106A to interior chamber 112 through fluid port 142 and barrier 144. Since, in this aspect, the flow of air is going to be used to push the volume of liquid 202 toward acoustic port 108, it is important that the flow of air enter interior chamber 112 at a point where it can push a maximum volume of liquid 202. In this aspect, fluid port 142 should be relatively far away from acoustic port 108. Representatively, fluid port 142 may be near one end of interior chamber 112, and acoustic port 108 may be near an opposite end of interior chamber 112. More specifically, where interior chamber 112 is considered to have a length dimension ($L_1$), fluid port 142 should be spaced a distance or length dimension ($L_2$) from acoustic port 108 that is at least one-half that of length dimension ($L_1$). For example, the distance or length ($L_2$) between fluid port 142 and acoustic port 108 may be more than one-half that of length ($L_1$), two-thirds that of length ($L_1$), three-quarters that of length ($L_1$) or substantially equal to length ($L_1$).

In addition, the volume, velocity and/or direction of air flow may be controlled to ensure a sufficient amount of liquid 202 is pushed out acoustic port 108. For example, in one aspect, the displacement of a volume of air from exterior chamber 106A to interior chamber 112 that is equivalent to, or greater than, a volume of interior chamber 112 may be sufficient to force liquid 202 out of interior chamber 112. For example, in one aspect, exterior chamber 106A may contain a volume of about 8 cubic centimeter (cc) to about 10 cc, and interior chamber 112 may have a volume of from about 0.1 cc to about 0.2 cc. Accordingly, in one aspect, the displacement of at least 0.1 cc of air, at least 0.2 cc of air, or more than 0.2 cc of air from exterior chamber 106A to interior chamber 112 may be sufficient to force liquid 202 out of interior chamber 112.

Still further, the velocity and/or direction of the air flow may be controlled by controlling the size, surface area and/or shape of the fluid port 142 and/or aspects of barrier 144. For example, the fluid port 142 and/or barrier 144 may be selected so that they are more/less resistant to fluid (e.g., air) flow. The specific aspects relating to the features of fluid port 142 and/or barrier 144 that can be used to control a velocity and/or direction of the air flow will be discussed in more detail in reference to FIG. 7 and FIG. 8.

Returning now to the mechanism for generating the stream or flow of air, in one aspect, the stream or flow of air may be generated by moving one or more of enclosure walls 102A-102D with respect to transducer module 104 so that a volume of air (e.g., 0.1 cc or more) is transferred from exterior chamber 106A to interior chamber 112 and pushes out any liquid (e.g., water) therein. More specifically, as illustrated in FIG. 3, an external force can be applied in a direction of arrow 208 against enclosure wall 102B. For example, the external force may be a user's finger pressing, and in some cases holding their finger against, enclosure wall 102B (e.g., a display screen). In this aspect, enclosure wall 102B can serve as the actuator or actuating mechanism for the pumping operation. It is noted that enclosure wall 102B is positioned over fluid port 142 and may therefore provide a relatively direct mechanism for forcing air through fluid port 142. An external force could, however, be applied to other walls of enclosure 102 (e.g., walls 102A, 102C and 102D) to drive air through fluid port 142.

Returning now to the movement of enclosure wall 102B specifically, the application of external force in the direction of arrow 208 causes enclosure wall 102B to move from a first position in which it is a first distance ($D_1$) from module wall 104A (as shown in FIG. 2), to a second position in which it is a second distance ($D_2$) from module wall 104A (as shown in FIG. 3). As can be seen from FIG. 2 and FIG. 3, the first distance ($D_1$) is larger than the second distance ($D_2$), such that in the second position, enclosure wall 102B is closer to module wall 104A than in the first position. In other words, the external force applied in the direction of arrow 208 squeezes enclosure 102 so that the volume of air within exterior chamber 106A is compressed. Since fluid port 142 is the only opening from exterior chamber 106A, a volume of air within exterior chamber 106A is forced to flow through fluid port 142 to interior chamber 112. This air stream continues in a direction of arrows 204 along interior chamber 112 toward acoustic port 108, thereby displacing the volume of liquid 202 therein. For example, when the air stream displaces the volume of liquid 202 in interior chamber 112, a pressure difference develops a net force over the liquid 202 and the liquid 202 is displaced until it is removed from interior chamber 112, via acoustic port 108. This process may be repeated several times until interior chamber 112 is completely cleared of liquid 202. It is noted that since the barrier 144 covering fluid port 142 is more resistant to liquids such as water than acoustic port 108 (and the flow of air is pushing the liquid 202 away from fluid port 142), a liquid 202 (e.g., water) does not pass, or otherwise leak back through, fluid port 142. In addition, it is noted that while FIG. 1-FIG. 3 illustrate a top ported device in which acoustic port 108 is through a top wall (e.g., top enclosure wall 102B and/or top module wall 104A), a similar pumping mechanism could be used in a side ported device to drive a fluid (e.g., water) out a side port. Moreover, in some cases, a single application of an external force can be applied, and held for a short or long period of time, to actuate the pumping mechanism, for example by a user pressing and holding their finger down on enclosure wall 102B. In other cases, the external force may be applied repeatedly, and held for short or long periods of time.

Referring now to FIG. 4, FIG. 4 illustrates a cross-sectional side view of another aspect of a transducer assembly. Transducer assembly 400 is substantially similar to transducer assembly 100 described in reference to FIG. 1-FIG. 3, and therefore the same components will not be described again. In this aspect, however, transducer assembly 400 is a side ported or side firing device and fluid removal is achieved by a suction or pulling force (as opposed to pushing) which ejects the fluid out of the interior chamber 112. More specifically, similar to transducer assembly 100 previously discussed in reference to FIG. 1-FIG. 3, transducer assembly 400 includes an enclosure 102 (e.g., a cosmetic enclosure of an electronic device) within which a transducer module 104 is positioned. Enclosure 102 may include enclosure walls 102A-102D, which each have an exterior surface 120A facing the surrounding environment and an interior surface 120B facing (or sharing a volume with) the encased space 106. Transducer module 104 may include module walls 104A-104D. One or more of the module walls 104A-104D, in combination with SRS 110, may form interior chamber 112 that is acoustically coupled to an acoustic port 408 (e.g., exit port) to the surrounding ambient environment. Here, however, acoustic port 408 is formed within a side wall of transducer module 104, for example side module wall 104D. Side module wall 104D may be considered a "side wall" as opposed to a "top wall" or "bottom wall" because it is perpendicular to, for example, the top face 110A of SRS 110 or a module wall (e.g., wall 104A) that is parallel to SRS 110 (and top face 110A). Since acoustic port 408 is formed through a side wall of module 104, and therefore the sound output (S) is out the side of module 104 (as shown by the arrow), transducer assembly 400 may be considered a side ported or side firing device. Other aspects of acoustic port 408, such as the size, shape, dimensions, surface area, etc., may, however, be similar to acoustic port 108 previously discussed in reference to FIG. 1-FIG. 3.

In addition, fluid port 410 is similar to fluid port 142 of FIG. 1-FIG. 3, except that in transducer assembly 400, fluid port 410 faces a different direction than acoustic port 408 and is positioned relatively close to acoustic port 408. For example, fluid port 410 faces a direction parallel to a direction of sound output from SRS 110 (e.g., a direction of arrow 122) or the same direction as top face 110A. Acoustic port 408, on the other hand, faces a different direction, for example, a direction perpendicular to the direction of sound output from SRS 110 or perpendicular to a direction faced by top face 110A.

Moreover, fluid port 410 is positioned relatively close to acoustic port 408 so that the exchange of an air volume between exterior chamber 106A and interior chamber 112, as previously discussed, can be used to create a negative, low, or otherwise reduced, pressure region near acoustic port 408. This negative, low or reduced pressure region is then used to pump a fluid from interior chamber 112 and out acoustic port 408 using a suction or pulling force. This type of pumping operation will now be discussed in reference to FIG. 5 and FIG. 6.

FIG. 5 and FIG. 6 illustrate a simplified cross-sectional schematic diagram of the transducer assembly and pumping mechanism of FIG. 4. In particular, as can be seen from FIG. 5 and previously discussed, interior chamber 112, which may be formed by module wall 104A and the top face 110A of SRS 110, forms an acoustic channel or tube through which sound can travel to acoustic port 108. Similarly, the liquid 202 (e.g., water), within interior chamber 112 can travel to acoustic port 408 and out to the ambient environment if a sufficient driving force is applied along the channel. In this case, the driving force may be created by a flow of air passing from exterior chamber 106A to interior chamber 112 through fluid port 410 (and barrier 144), in combination with a low or negative pressure region 602 formed near acoustic port 408.

In particular, similar to the pumping mechanism of transducer assembly 100, in transducer assembly 400, a volume of air from exterior chamber 106A is forced through fluid port 410 (and barrier 144) into interior chamber 112. For example, by applying an external force in direction 208 against enclosure wall 102B, as previously discussed. In transducer assembly 400, however, fluid port 410 is positioned relatively close to acoustic port 408. For example, in transducer assembly 400, a distance or length ($L_3$) between fluid port 410 and acoustic port 408 may be one-half a length ($L_1$) or less, or one-quarter a length ($L_1$) or less, or one-eighth a length ($L_1$) or less than that of acoustic chamber 112.

When fluid port 410 is positioned near acoustic port 408 in this manner, the stream or flow of air through fluid port 410 can be controlled such that it passes over the liquid 202 within interior chamber 112 and is directed toward acoustic port 408, as shown by arrow 604 in FIG. 6. The velocity of this stream or flow of fluid air shown by arrow 604 creates a reduced or low pressure (−P) over the liquid 202, for example, lower than a pressure (+P) within interior chamber 112. In addition, a reduced, low, or negative pressure region 602 is created near acoustic port 408 (e.g., the pressure is less than ambient pressure). This pressure difference generated inside the device (e.g., around 1.5 kPa) can then be used to displace the liquid 202 within the low or negative pressure region 602, and the remaining fluid within region 608 of interior chamber 112 is carried out by the pressure difference generated by the fluid being displaced by the air flow.

Referring now to one exemplary mechanism for generating the air flow and pressure regions, in one aspect, the external force is applied in direction 208 to enclosure wall 102B to cause a stream or flow of fluid (e.g., air) to pass through fluid port 410 from exterior chamber 106A to interior chamber 112, as illustrated by arrow 604. It is noted that it is desirable for the air to flow relatively quickly into interior chamber 112. Therefore to control or otherwise increase the speed or velocity of the fluid flow, fluid port 410 may have a particular size, shape, surface area, or other aspects, found suitable for achieving the desired flow speed. For example, fluid port 410 may have a relatively small surface area, for example, smaller than a surface area of acoustic port 408. Some specific aspects of fluid port 410

Figure 7:
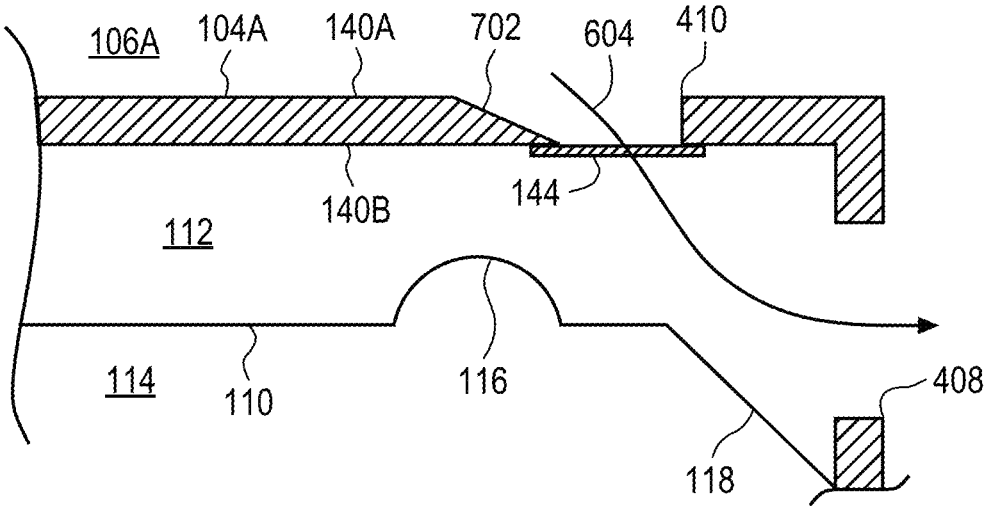
FIG. 7 illustrates a magnified cross-sectional view of one aspect of a transducer assembly port.

(and fluid port 142) will be discussed in more detail in reference to FIG. 7 and FIG. 8.

This initial introduction of a stream or flow of air into interior chamber 112, as illustrated by arrow 604, creates a reduced, low or negative pressure region 602 between fluid port 410 and acoustic port 408, as well as a relatively low pressure region in the remaining fluid region 608. These low and/or negative pressure regions 602 and 608, in turn, create a suction force that pulls liquid 202 out acoustic port 408 in a direction as illustrated by arrow 610. In some cases, this action of applying force in a direction of arrow 208 (e.g., squeezing) is repeated more than once to create these low or negative pressure regions, and remove liquid 202. For example, in one aspect, a first push or squeeze of enclosure wall 102A is used to drive a fluid (e.g., air) from exterior chamber 106A to interior chamber 112 and create one of the low or negative pressure regions (e.g., region 602) and then a second push or squeeze on enclosure wall 102A is used to eject the remaining amount of fluid (e.g., fluid in region 608) out acoustic port 408. Each squeeze pulls the liquid 202 out acoustic port 408 in a step-by-step manner, therefore multiple fast squeezes may be used to completely remove liquid 202 from interior chamber 112.

The particular size, shape, surface area, and/or other aspects, of the fluid port which can be selected to achieve the desired pumping operation will now be described in more detail in reference to FIG. 7 and FIG. 8. FIG. 7 and FIG. 8 illustrate magnified cross-sectional views of aspects of the fluid port and barrier of FIG. 4-FIG. 6, however, the description here may also apply to the fluid port and barrier illustrated in FIG. 1-FIG. 3.

Returning now to FIG. 7, FIG. 7 illustrates fluid port 410 and barrier 144 positioned in close proximity to acoustic port 408, as previously discussed. As previously discussed, it is desirable for the air stream traveling through fluid port 410 and barrier 144 to flow at a relatively fast speed and toward acoustic port 408 as illustrated by arrow 604. To help direct the air stream toward acoustic port 408, fluid port 410 may have a sloped or inclined surface 702. The sloped or inclined surface 702 may be sloped or inclined at an angle sufficient to direct the air stream toward acoustic port 408. For example, the sloped or inclined surface 702 may slope or taper toward interior module wall surface 140B. In other words, inclined surface 702 is tapered so that module wall 104A becomes thinner in a direction from surface 140A toward surface 140B.

Figure 8:
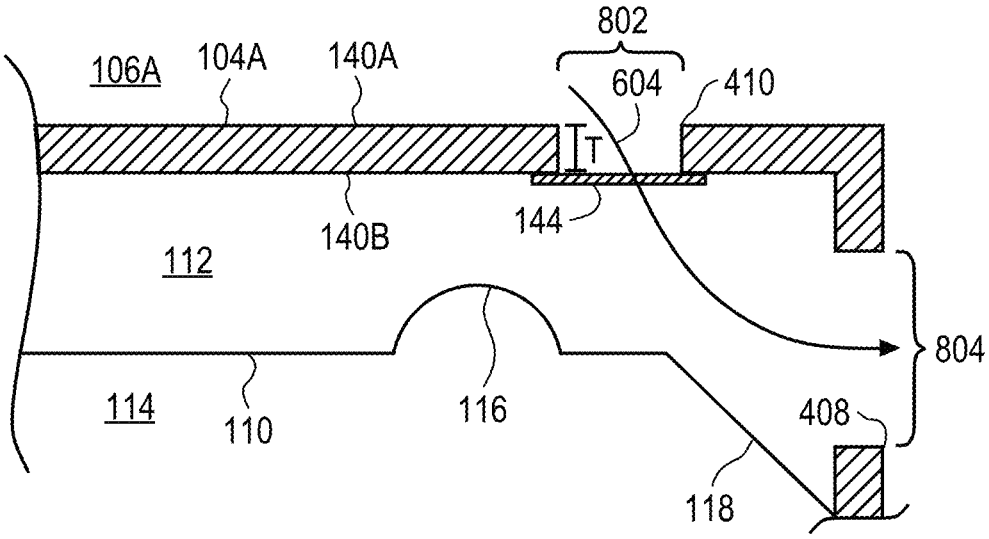
FIG. 8 illustrates a magnified cross-sectional view of another aspect of a transducer assembly port.

In addition, FIG. 8 illustrates the additional aspects of a surface area 802 or pathway thickness (T) of fluid port 410 being specially selected to achieve a desired speed or rate of fluid flow into interior chamber 112. For example, in some cases, surface area 802 of fluid port 410 may be smaller or narrower than surface area 804 of exit port 408. For example, surface area 802 could, in one aspect, be of a size suitable for accomplishing a second function, for example, that of a barometric vent. In addition, in some cases a thickness (T) of fluid port 410 may be increased or decreased to increase or decrease a resistance of the pathway to fluid flow, and in turn, control the speed of the air stream flowing into interior chamber 112. Moreover, as previously discussed, although fluid port 410 is shown having a single opening, fluid port 410 could be made up of multiple openings or perforations. The multiple openings could each have a same surface area, shape and/or size, or different surface areas, shapes or sizes. Each of the openings, however, could in combination, have a desired overall surface area similar to that of the single opening disclosed in FIG. 8.

Still further, it should be understood that aspects of barrier 144 may also be used to control a direction, speed, velocity, volume, or other aspects, of the passage of fluid through fluid port 410. For example, barrier 144 may have a particular stiffness, transparency to air flow and/or resistance to fluids such as water, which may also impact the passage of air flow into the interior chamber 112. In one aspect, barrier 144 may be made of a mesh material that is considered transparent to acoustic and air passage, but resistant to the passage of water there through. In addition, barrier 144 may be made of a material, or have a structure, so that it is relatively rigid while still being open to air passage. In one aspect, barrier 144 could be a mesh made of PTFE. In still further aspects, barrier 144 could include multiple layers of material, for example, a layer of PTFE and a layer of pressure sensitive adhesive material.

Figure 9:
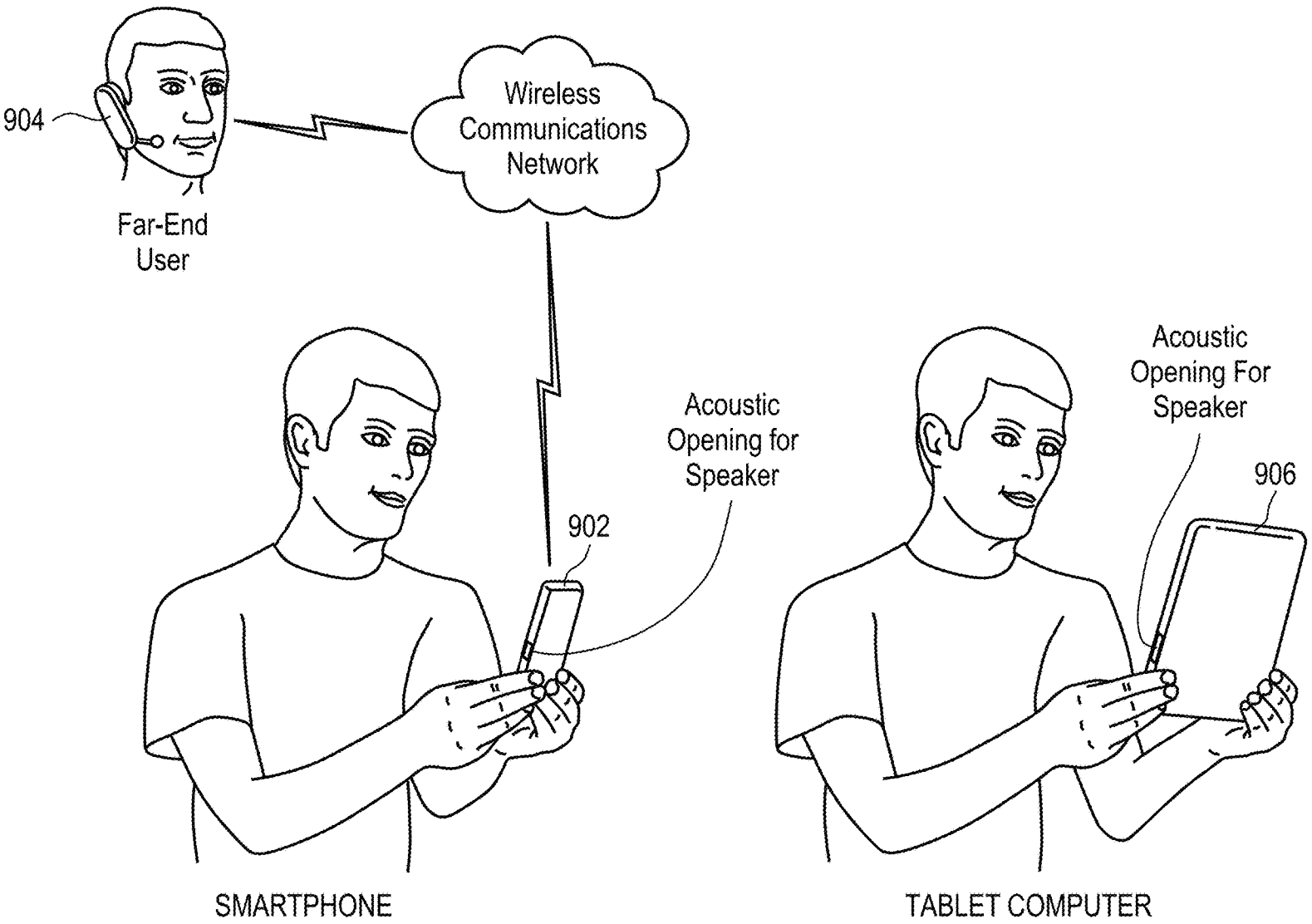
FIG. 9 illustrates one aspect of a simplified schematic view of one aspect of an electronic device in which one or more aspects may be implemented.

FIG. 9 illustrates one aspect of a simplified schematic view of one aspect of an electronic device in which a transducer (e.g., a micro speaker), such as that described herein, may be implemented. As seen in FIG. 9, the transducer may be integrated within a consumer electronic device 902 such as a smart phone with which a user can conduct a call with a far-end user of a communications device 904 over a wireless communications network; in another example, the speaker may be integrated within the housing of a tablet computer 906. These are just two examples of where the speaker described herein may be used, it is contemplated, however, that the speaker may be used with any type of electronic device in which a transducer, for example, a loudspeaker or microphone, is desired, for example, a tablet computer, a desk top computing device or other display device.

Figure 10:
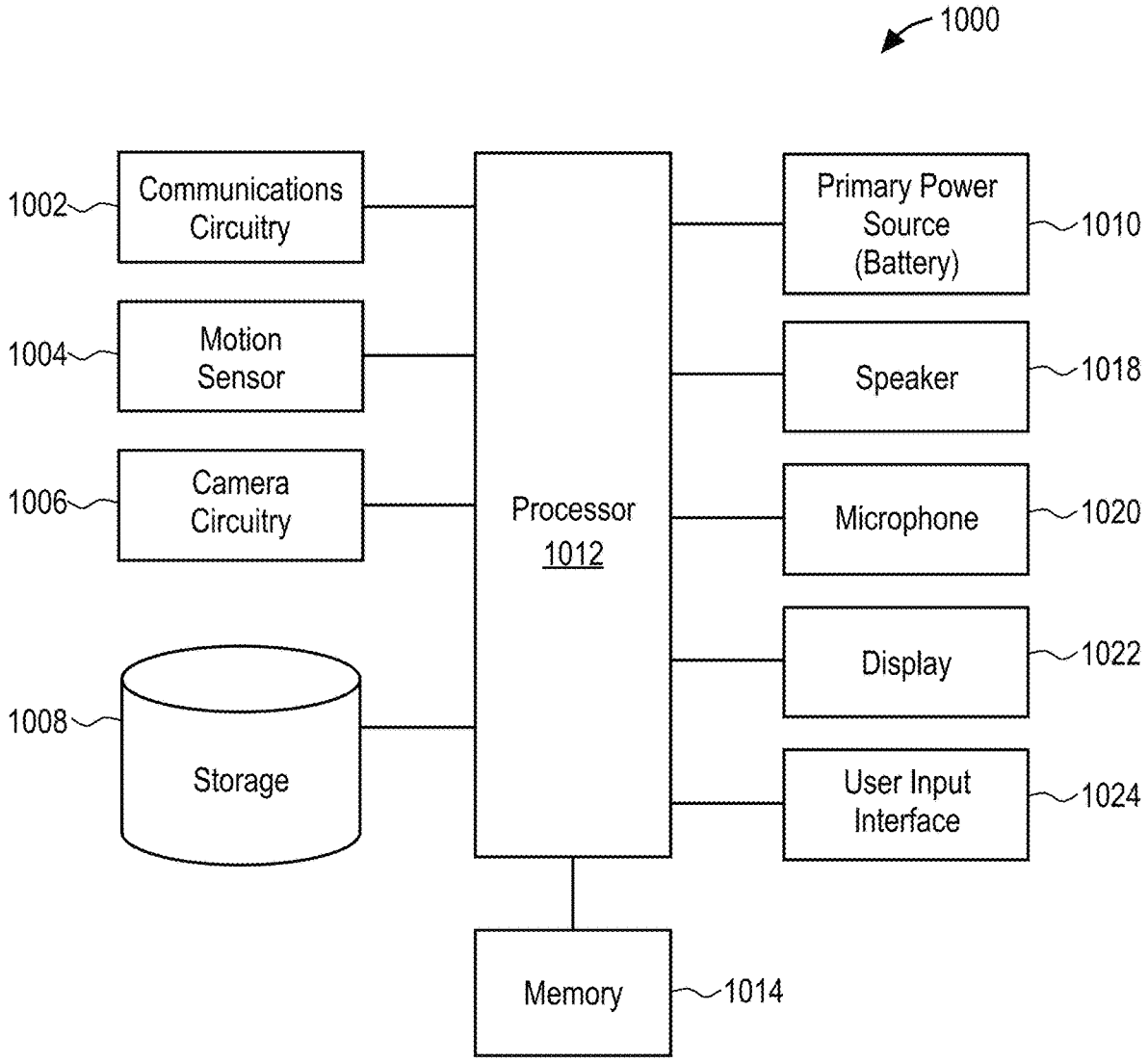
FIG. 10 illustrates a block diagram of some of the constituent components of an aspect of an electronic device in which one or more aspects may be implemented.

FIG. 10 illustrates a block diagram of some of the constituent components of an aspect of an electronic device in which one or more aspects may be implemented. Device 1000 may be any one of several different types of consumer electronic devices. For example, the device 1000 may be any transducer-equipped mobile device, such as a cellular phone, a smart phone, a media player, or a tablet-like portable computer.

In this aspect, electronic device 1000 includes a processor 1012 that interacts with camera circuitry 1006, motion sensor 1004, storage 1008, memory 1014, display 1022, and user input interface 1024. Main processor 1012 may also interact with communications circuitry 1002, primary power source 1010, speaker 1018 and microphone 1020. Speaker 1018 may be a micro speaker such as that described in reference to FIG. 1-FIG. 8. The various components of the electronic device 1000 may be digitally interconnected and used or managed by a software stack being executed by the processor 1012. Many of the components shown or described here may be implemented as one or more dedicated hardware units and/or a programmed processor (software being executed by a processor, e.g., the processor 1012).

The processor 1012 controls the overall operation of the device 1000 by performing some or all of the operations of one or more applications or operating system programs implemented on the device 1000, by executing instructions for it (software code and data) that may be found in the storage 1008. The processor 1012 may, for example, drive the display 1022 and receive user inputs through the user input interface 1024 (which may be integrated with the display 1022 as part of a single, touch sensitive display panel). In addition, processor 1012 may send an audio signal to speaker 1018 to facilitate operation of speaker 1018.

Storage 1008 provides a relatively large amount of "permanent" data storage, using nonvolatile solid state memory (e.g., flash storage) and/or a kinetic nonvolatile storage device (e.g., rotating magnetic disk drive). Storage 1008 may include both local storage and storage space on a remote server. Storage 1008 may store data as well as software components that control and manage, at a higher level, the different functions of the device 1000.

In addition to storage 1008, there may be memory 1014, also referred to as main memory or program memory, which provides relatively fast access to stored code and data that is being executed by the processor 1012. Memory 1014 may include solid state random access memory (RAM), e.g., static RAM or dynamic RAM. There may be one or more processors, e.g., processor 1012, that run or execute various software programs, modules, or sets of instructions (e.g., applications) that, while stored permanently in the storage 1008, have been transferred to the memory 1014 for execution, to perform the various functions described above.

The device 1000 may include communications circuitry 1002. Communications circuitry 1002 may include components used for wired or wireless communications, such as two-way conversations and data transfers. For example, communications circuitry 1002 may include RF communications circuitry that is coupled to an antenna, so that the user of the device 1000 can place or receive a call through a wireless communications network. The RF communications circuitry may include a RF transceiver and a cellular baseband processor to enable the call through a cellular network. For example, communications circuitry 1002 may include Wi-Fi communications circuitry so that the user of the device 1000 may place or initiate a call using voice over Internet Protocol (VOIP) connection, transfer data through a wireless local area network.

The device may include a microphone 1020. Microphone 1020 may be an acoustic-to-electric transducer or sensor that converts sound in air into an electrical signal. The microphone circuitry may be electrically connected to processor 1012 and power source 1010 to facilitate the microphone operation (e.g., tilting).

The device 1000 may include a motion sensor 1004, also referred to as an inertial sensor, that may be used to detect movement of the device 1000. The motion sensor 1004 may include a position, orientation, or movement (POM) sensor, such as an accelerometer, a gyroscope, a light sensor, an infrared (IR) sensor, a proximity sensor, a capacitive proximity sensor, an acoustic sensor, a sonic or sonar sensor, a radar sensor, an image sensor, a video sensor, a global positioning (GPS) detector, an RF or acoustic doppler detector, a compass, a magnetometer, or other like sensor. For example, the motion sensor 1004 may be a light sensor that detects movement or absence of movement of the device 1000, by detecting the intensity of ambient light or a sudden change in the intensity of ambient light. The motion sensor 1004 generates a signal based on at least one of a position, orientation, and movement of the device 1000. The signal may include the character of the motion, such as acceleration, velocity, direction, directional change, duration, amplitude, frequency, or any other characterization of movement. The processor 1012 receives the sensor signal and controls one or more operations of the device 1000 based in part on the sensor signal.

The device 1000 also includes camera circuitry 1006 that implements the digital camera functionality of the device 1000. One or more solid state image sensors are built into the device 1000, and each may be located at a focal plane of an optical system that includes a respective lens. An optical image of a scene within the camera's field of view is formed on the image sensor, and the sensor responds by capturing the scene in the form of a digital image or picture consisting of pixels that may then be stored in storage 1008. The camera circuitry 1006 may also be used to capture video images of a scene.

Device 1000 also includes primary power source 1010, such as a built in battery, as a primary power supply.

While certain aspects have been described and shown in the accompanying drawings, it is to be understood that such aspects are merely illustrative of and not restrictive on the broad invention, and that the invention is not limited to the specific constructions and arrangements shown and described, since various other modifications may occur to those of ordinary skill in the art. For example, the various speaker components described herein could be used in an acoustic-to-electric transducer or other sensor that converts sound in air into an electrical signal, such as for example, a microphone. The description is thus to be regarded as illustrative instead of limiting. In addition, to aid the Patent Office and any readers of any patent issued on this application in interpreting the claims appended hereto, applicants wish to note that they do not intend any of the appended claims or claim elements to invoice 35 U.S.C. 112(f) unless the words "means for" or "step for" are explicitly used in the particular claim.

What is claimed is:

1. A transducer assembly comprising:

a transducer enclosure having an enclosure wall separating a surrounding ambient environment from an encased space; and a transducer module positioned within the encased space, the transducer module having a module wall that divides the encased space into an exterior chamber and an interior chamber and defines a fluid port between the exterior chamber and the interior chamber, the exterior chamber is between the module wall and the enclosure wall, the interior chamber is between the module wall and a sound radiating surface positioned within the transducer module, the interior chamber is acoustically coupled to an acoustic port to the surrounding ambient environment, wherein the enclosure wall is configured to move relative to the module wall, and movement of the enclosure wall causes a volume of air within the exterior chamber to flow through the fluid port to the interior chamber and water within the interior chamber to flow through the acoustic port to the ambient environment.

2. The transducer assembly of claim 1 wherein the module wall comprises a top module wall that is parallel to a top enclosure wall of the enclosure wall, and the fluid port and the acoustic port are formed through the top module wall.

3. The transducer assembly of claim 1 wherein the interior chamber comprises a length dimension, and the fluid port is spaced a distance from the acoustic port that is at least ½ the length dimension of the interior chamber.

4. The transducer assembly of claim 1 wherein the fluid port comprises a surface area sufficient to allow for passage of at least 0.1 cc of air from the exterior chamber to the interior chamber.

5. The transducer assembly of claim 1 wherein the flow of the volume of air through the fluid port to the interior chamber pushes the water through the acoustic port to the surrounding ambient environment.

6. The transducer assembly of claim 1 wherein the module wall comprises a top module wall and a side module wall that is perpendicular to the top module wall, and the fluid port is formed through the top module wall and the acoustic port is formed through the side module wall.

7. The transducer assembly of claim 1 wherein the interior chamber comprises a length dimension, and the fluid port is spaced a distance from the acoustic port that is less than ½ the length dimension of the interior chamber.

8. The transducer assembly of claim 1 wherein the fluid port comprises an angled interior surface to direct a flow of air generated by the movement of the enclosure wall from the exterior chamber toward the acoustic port.

9. The transducer assembly of claim 1 wherein the flow of the volume of air through the fluid port to the interior chamber creates a reduced pressure region within the interior chamber that pulls the water out the acoustic port.

10. The transducer assembly of claim 1 further comprising:

an air permeable water barrier positioned over the fluid port, wherein the air permeable water barrier is permeable to air and resistant to water.

11. The transducer assembly of claim 1 wherein the transducer module comprises a micro speaker module.

12. An integrated micro speaker and pump assembly comprising:

a micro speaker enclosure having an enclosure wall separating a surrounding ambient environment from an encased space; and a micro speaker module positioned within the encased space, the micro speaker module having a module wall, the module wall defining an acoustic chamber and a fluid port, the acoustic chamber acoustically coupling a sound radiating surface within the micro speaker module to an acoustic port that is open to the surrounding ambient environment, the fluid port fluidly coupling the acoustic chamber to the encased space surrounding the micro speaker module, and wherein the fluid port allows for passage of a first fluid from the encased space surrounding the micro speaker module to the acoustic chamber to drive a second fluid out of the acoustic chamber to the surrounding ambient environment, wherein the first fluid is different than the second fluid, and wherein the enclosure wall is movable in response to an external force against the enclosure wall, and the external force is in a direction of the micro speaker module.

13. The integrated micro speaker and pump assembly of claim 12 wherein the sound radiating surface is a micro speaker diaphragm that generates a sound output, and the fluid port and the acoustic port face a direction parallel to a direction of the sound output.

14. The integrated micro speaker and pump assembly of claim 12 wherein the fluid port is spaced a distance from the acoustic port sufficient to allow the first fluid from the encased space surrounding the micro speaker module to enter the acoustic chamber and push the second fluid out of the acoustic chamber.

15. The integrated micro speaker and pump assembly of claim 12 wherein the sound radiating surface is a micro speaker diaphragm that generates a sound output, and the fluid port faces a direction parallel to a direction of the sound output from the micro speaker diaphragm and the acoustic port faces a direction perpendicular to the direction of sound output.

16. The integrated micro speaker and pump assembly of claim 12 wherein the fluid port is spaced a distance from the acoustic port sufficient to allow the first fluid from the encased space surrounding the micro speaker module to enter the acoustic chamber and create a negative pressure area near the acoustic port.

17. The integrated micro speaker and pump assembly of claim 12 wherein the enclosure wall is movable between a first position and a second position, and a movement of the enclosure wall between the first position and the second position causes a volume of air to flow through the fluid port to the acoustic chamber.

18. The integrated micro speaker and pump assembly of claim 12 wherein a volume of the acoustic chamber is smaller than a volume of the encased space surrounding the micro speaker module.

19. The integrated micro speaker and pump assembly of claim 12 wherein a surface area of the fluid port is smaller than a surface area of the acoustic port.

20. The integrated micro speaker and pump assembly of claim 12 further comprising:

a water resistant membrane positioned over the fluid port, wherein the water resistant membrane comprises polytetrafluoroethylene (PTFE).

21. A micro speaker system comprising:

a micro speaker having a front volume chamber that acoustically couples a sound radiating surface to an acoustic port for outputting a sound generated by the sound radiating surface to a surrounding ambient environment;

an electronic device enclosure surrounding the micro speaker, the electronic device enclosure having an enclosure wall that forms an exterior chamber around the micro speaker, the exterior chamber having a larger volume than the front volume chamber, and wherein the enclosure wall comprises an interior surface that shares a volume with the exterior chamber and an exterior surface that forms a cosmetic surface of the electronic device enclosure that is exposed to the surrounding ambient environment; and a nozzle formed between the front volume chamber and the exterior chamber, the nozzle to allow for passage of a volume of air from the exterior chamber to the front volume chamber such that a volume of liquid within the front volume chamber is pumped out the acoustic port to the surrounding ambient environment.

22. The micro speaker system of claim 21 wherein the enclosure wall is movable between a first position that is a first distance from the micro speaker and a second position that is a second distance from the enclosure wall, the second distance being less than the first distance, and a movement of the enclosure wall from the first position to the second position causes the volume of air to flow through the nozzle to the front volume chamber.

23. The micro speaker system of claim 22 wherein repeating the movement of the enclosure wall from the first position to the second position more than once causes the volume of air to flow through the nozzle to the front volume chamber.

24. The micro speaker system of claim 22 wherein the front volume chamber comprises a negative pressure region between the nozzle and the acoustic port, and the negative pressure region draws the volume of liquid out the acoustic port.

25. The micro speaker system of claim 21 wherein the nozzle comprises an air permeable mesh that is resistant to liquid.

* * * * *